US011519102B2

(12) United States Patent
Miyauchi et al.

(10) Patent No.: US 11,519,102 B2
(45) Date of Patent: Dec. 6, 2022

(54) THERMO-FUSIBLE CONJUGATED FIBERS AND NONWOVEN FABRIC USING SAME

(71) Applicants: ES FIBERVISIONS (SUZHOU) CO., LTD., Suzhou (CN); ES FiberVisions CO., LTD., Osaka (JP); ES FiberVisions Hong Kong Limited, Hong Kong (HK); ES FiberVisions LP, Athens, GA (US); ES FiberVisions ApS, Varde (DK)

(72) Inventors: Minoru Miyauchi, Osaka (JP); Shinichi Unno, Osaka (JP)

(73) Assignees: ES FIBERVISIONS (SUZHOU) CO., LTD., Suzhou (CN); ES FiberVisions CO., LTD., Osaka (JP); ES FiberVisions Hong Kong Limited, Hong Kong (CN); ES FiberVisions LP; ES FiberVisions ApS, Varde (DK)

( * ) Notice: Subject to any disclaimer, the term of this patent is extended or adjusted under 35 U.S.C. 154(b) by 151 days.

(21) Appl. No.: 16/499,321

(22) PCT Filed: Jun. 27, 2017

(86) PCT No.: PCT/JP2017/023642
§ 371 (c)(1),
(2) Date: Nov. 7, 2019

(87) PCT Pub. No.: WO2018/179464
PCT Pub. Date: Oct. 4, 2018

(65) Prior Publication Data

US 2020/0385890 A1 Dec. 10, 2020

(30) Foreign Application Priority Data

Mar. 31, 2017 (JP) ..... JP2017-072662

(51) Int. Cl.
*D01F 8/06* (2006.01)
*D04H 1/541* (2012.01)
(Continued)

(52) U.S. Cl.
CPC ..... *D01F 8/06* (2013.01); *D01F 8/14* (2013.01); *D04H 1/5412* (2020.05); *D04H 3/007* (2013.01); *D04H 3/011* (2013.01)

(58) Field of Classification Search
CPC ..... D01F 8/06; D01F 8/14; D04H 1/5412; D04H 3/007; D04H 3/011; D04H 1/541
See application file for complete search history.

(56) References Cited

U.S. PATENT DOCUMENTS 5,106,552 A * 4/1992 Goi ..... B01D 39/163 210/497.01
2009/0029165 A1 1/2009 Goda
(Continued)

FOREIGN PATENT DOCUMENTS

CN 101522964 9/2009
CN 101896653 11/2010
(Continued)

OTHER PUBLICATIONS

Spalding, Mark A. Chatterjee, Ananda M.. (2018). Handbook of Industrial Polyethylene and Technology—Definitive Guide to Manufacturing, Properties, Processing, Applications and Markets. John Wiley & Sons.*
(Continued)

*Primary Examiner* — Jennifer A Gillett
(74) *Attorney, Agent, or Firm* — JCIPRNET

(57) ABSTRACT

An object of the invention is to provide thermo-fusible conjugated fibers capable of suppressing damage to the fibers upon processing the fibers into a nonwoven fabric web. The thermo-fusible conjugated fibers of the invention
(Continued)

contain a first component containing a polyester-based resin and a second component containing a polyolefin-based resin, in which a melting point of the second component is 10° C. or more lower than a melting point of the first component, and a work load at break obtained by a tensile test is 1.6 cN·cm/dtex or more. The damage to the fibers is suppressed by the thermo-fusible conjugated fibers of the invention, and therefore the nonwoven fabric with higher quality can be obtained with higher productivity than ever before.

9 Claims, 1 Drawing Sheet

(51) Int. Cl.

| | |
|---|---|
| ***D01F 8/14*** | (2006.01) |
| ***D04H 3/007*** | (2012.01) |
| ***D04H 3/011*** | (2012.01) |

(56) References Cited

U.S. PATENT DOCUMENTS

| | | | | |
|---|---|---|---|---|
| 2010/0273947 | A1 | 10/2010 | Miyauchi et al. | |
| 2012/0302119 | A1* | 11/2012 | Clark | D01H 13/24 428/401 |
| 2016/0115630 | A1 | 4/2016 | Kubota et al. | |

FOREIGN PATENT DOCUMENTS

| | | | | |
|---|---|---|---|---|
| CN | 102639770 | | 8/2012 | |
| CN | 103014911 | | 4/2013 | |
| CN | 105283589 | | 1/2016 | |
| EP | 3004438 | | 4/2016 | |
| JP | 2003328233 | | 11/2003 | |
| JP | 2007204901 | | 8/2007 | |
| JP | 2009114613 | | 5/2009 | |
| JP | 2013133571 | | 7/2013 | |
| JP | 2014234559 | | 12/2014 | |
| TW | 200809022 | | 2/2008 | |
| WO | WO-2014192976 | A1 * | 12/2014 | B29C 55/005 |

OTHER PUBLICATIONS

Rao, Natti S. (2017). Basic Polymer Engineering Data. Hanser Publishers.*

Haji, Aminoddin, Rouhollah Rahbar, and Bahareh Kalantari, The Effect of Hot Multistage Drawing on Molecular Structure and Optical Properties of Polyethylene Terephthalate Fibers, Materials Research 15(4), Aug. 2021 p. 554-560.*

"Written Opinion of the International Searching Authority (Form PCT/ISA/237) of PCT/JP2017/023642", dated Aug. 1, 2017, with English translation thereof, pp. 1-12.

"Search Report of Europe Counterpart Application", dated Aug. 11, 2020, p. 1-p. 7.

"Office Action of China Counterpart Application", dated Nov. 30, 2018, with English translation thereof, p. 1-p. 15.

"International Search Report (Form PCT/ISA/210) of PCT/JP2017/023642," dated Aug. 1, 2017, with English translation thereof, pp. 1-5.

"Office Action of Japan Counterpart Application", dated Jul. 25, 2017, with English translation thereof, p. 1-p. 8.

"Office Action of China Counterpart Application", dated Apr. 29, 2019, with English translation thereof, p. 1-p. 8.

"Office Action of Taiwan Counterpart Application" with English translation thereof, dated Aug. 19, 2021, p. 1-p. 19.

* cited by examiner

THERMO-FUSIBLE CONJUGATED FIBERS AND NONWOVEN FABRIC USING SAME

CROSS-REFERENCE TO RELATED APPLICATION

This application is a 371 application of the International PCT application serial no. PCT/JP2017/023642, filed on Jun. 27, 2017, which claims the priority benefit of Japan Patent Application No. 2017-072662, filed on Mar. 31, 2017. The entirety of each of the above-mentioned patent applications is hereby incorporated by reference herein and made a part of this specification.

TECHNICAL FIELD

The invention relates to thermo-fusible conjugated fibers, and a nonwoven fabric obtained by using the same.

BACKGROUND ART

In thermo-fusible conjugated fibers capable of interfiber bonding by thermal fusion by utilizing hot air, heat energy of a heat roll or the like, a nonwoven fabric excellent in bulkiness and flexibility is easy to obtain, and the nonwoven fabric has been widely used in a hygienic material application such as a diaper, a napkin and a pad, or an industrial material application such as a simple wiper, a filter and a separator.

In recent years, a thermo-fusible nonwoven fabric formed of the thermo-fusible conjugated fibers has been required to be supplied at a lower price and with higher quality in order to expand the applications. Furthermore, particularly in the hygienic material application and the filter application, the nonwoven fabric is desired to be formed of finer thermo-fusible conjugated fibers in order to improve flexibility and filtration characteristics thereof. However, if a fiber diameter of the thermo-fusible conjugated fiber becomes small, strength per fiber is reduced, and crimp-retaining characteristics that secure nonwoven fabric processability and nonwoven fabric bulkiness are also reduced, and therefore an issue in which satisfactory nonwoven fabric processability and nonwoven fabric physical properties are unable to be obtained has remained.

For the issue, the thermo-fusible conjugated fibers that can satisfy both processability into the nonwoven fabric and nonwoven fabric physical properties such as flexibility have been proposed. For example, Patent literature No. 1 discloses that stretching with a high ratio is performed by using a stretching bath filled with pressurized saturated water vapor to form conjugated fibers having high fiber strength and a high Young's modulus, whereby a dense and soft nonwoven fabric can be obtained with good productivity.

Moreover, Patent literature No. 2 discloses that thermo-fusible conjugated fibers in which high-speed carding performance is good and defects of a nonwoven fabric are significantly reduced can be obtained by adjusting fineness of the thermo-fusible conjugated fibers, a ratio of the number of crimps to a crimp ratio, a difference between a maximum value and a minimum value of the number of crimps and a sliver drawing resistance value into desired ranges, respectively.

REFERENCE LIST

Patent Literature

Patent literature No. 1: JP 2003-328233 A
Patent literature No. 2: JP 2013-133571 A

SUMMARY OF INVENTION

Technical Problem

However, in the technology of Patent literature No. 1, thermo-fusible conjugated fibers stretched by a stretching method have features in which, while the fibers have high strength and a high Young's modulus, the fibers have low elongation and a small work load (energy) required for breaking the fibers. If such fibers are intended to be processed into a nonwoven fabric at a high speed, large force acts thereon instantaneously or continuously in a fiber-opening process or a web-forming process, for example, and therefore such a problem has remained as breaking of the fibers to form broken flocks and mixing into a nonwoven fabric product, or reduction of tensile strength of the resulting nonwoven fabric, and a nonwoven fabric processing speed has been restricted by themselves. Moreover, in the technology of Patent literature No. 2, in order to adjust the values of physical properties to desired ranges, a problem such as a need for special production facilities, limitation of production conditions and reduction of a production yield has occurred, and the issue has been desired to be solved by another technique.

Accordingly, an object of the invention is to provide thermo-fusible conjugated fibers that can satisfy both processability into a nonwoven fabric and nonwoven fabric physical properties such as strength and flexibility.

Solution to Problem

In order to achieve the object described above, the present inventors have diligently continued to conduct research, and as a result, have found that the object can be achieved by focusing on a work load at break calculated from a stress-strain curve during a tensile test of thermo-fusible conjugated fibers to form tough thermo-fusible conjugated fibers in which a rise of stress by deformation acting on the fibers during processing into a nonwoven fabric is suppressed, and have completed the invention based on the finding.

More specifically, the invention has a structure as described below.

Item 1. Thermo-fusible conjugated fibers comprising a first component containing a polyester-based resin and a second component containing a polyolefin-based resin, wherein a melting point of the second component is 10° C. or more lower than a melting point of the first component, and a work load at break obtained by a tensile test is 1.6 cN·cm/dtex or more.

Item 2. The thermo-fusible conjugated fibers according to item 1, wherein a ratio of strength at break to elongation at break (strength at break [cN/dtex]/elongation at break [%]) obtained by a tensile test is 0.005 to 0.040.

Item 3. The thermo-fusible conjugated fibers according to item 1 or 2, wherein the first component is polyethylene terephthalate, and the second component is polyethylene.

Item 4. The thermo-fusible conjugated fibers according to item 3, wherein a degree of crystallinity of the polyethylene terephthalate is 18% or more.

Item 5. A nonwoven fabric, obtained by processing the thermo-fusible conjugated fibers according to any one of items 1 to 4.

Item 6. A product, using the nonwoven fabric according to item 5.

Advantageous Effects of Invention

Thermo-fusible conjugated fibers of the invention have a large work load at break calculated from a stress-strain curve during a tensile test, and have toughness, and therefore are excellent in stability in a nonwoven fabric web-forming process. Specifically, upon intending to form a nonwoven fabric web at a high speed, even if large deformation stress acts on the fibers, the fibers cause no break, and generation of fiber broken flocks and defects such as texture disorder of a web can be suppressed, and a high-quality thermo-fused nonwoven fabric having a combination of bulkiness, flexibility and mechanical characteristics can be obtained with high productivity. Furthermore, a nonwoven fabric obtained from the thermo-fusible conjugated fibers of the invention has features of increased nonwoven fabric strength, and mild thermally fusing conditions are applied in anticipation of the features, whereby a bulky and flexible nonwoven fabric can also be obtained while maintaining required nonwoven fabric strength.

DESCRIPTION OF EMBODIMENTS

Figure 1:
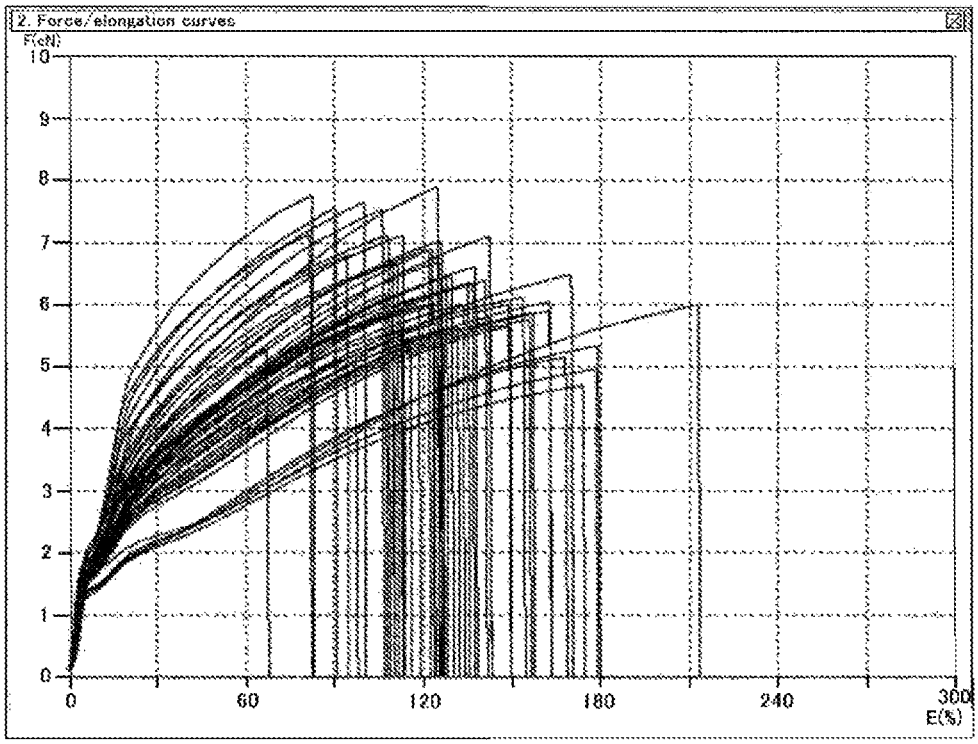
FIG. 1 is a diagram showing measured results of a stress-strain curve of thermo-fusible conjugated fibers in Example 2.

Hereinafter, the invention will be described in more detail.

Thermo-fusible conjugated fibers of the invention contain a first component containing a polyester-based resin and a second component containing a polyolefin-based resin, and a melting point of the second component is 10° C. or more lower than a melting point of the first component, and a work load at break obtained by a tensile test is 1.6 cN·cm/dtex or more.

Specific examples of the polyester-based resin forming the first component of the thermo-fusible conjugated fibers of the invention include, but are not particularly limited to, polyalkylene terephthalates such as polyethylene terephthalate, polytrimethylene terephthalate and polybutylene terephthalate, and biodegradable polyester such as polylactic acid, and a copolymer of the compounds and other ester-forming components. Specific examples of other ester-forming components include glycols such as diethylene glycol and polymethylene glycol, and aromatic dicarboxylic acid such as isophthalic acid and hexahydroterephthalic acid. In the case of the copolymer with other ester-forming components, a copolymerization composition is not particularly limited, but is preferably to an extent to which a degree of crystallinity is not significantly adversely affected, and from such a viewpoint, a content of a copolymerization component is preferably 10% or less, and further preferably 5% or less. The polyester-based resins may be used alone, or may be used in combination of two or more kinds without any problem. Further, the first component may contain the polyester-based resin, and may contain other resin components in the range in which advantageous effects of the invention are not adversely affected, and a content of the polyester-based resin on the occasion is desirably 80 wt % or more, and further desirably 90 wt % or more. Above all, if availability, raw material cost, thermal stability of the fibers obtained and the like are taken into consideration, the first component is most preferably composed only of polyethylene terephthalate.

The second component forming the thermo-fusible conjugated fibers of the invention contains the polyolefin-based resin, and has a melting point 10° C. or more lower than the melting point of the first component. The polyolefin-based resin forming the second component is not particularly limited as long as the resin satisfies conditions of having the melting point 10° C. or more lower than the melting point of the polyester-based resin being the first component. Specific examples thereof include low density polyethylene, linear low density polyethylene, high density polyethylene, a maleic anhydride-modified product of the ethylenic polymer, an ethylene-propylene copolymer, an ethylene-butene copolymer, an ethylene-butene-propylene copolymer, polypropylene, a maleic anhydride-modified product of the propylene-based polymer, and poly-4-methylpentene-1. The olefinic polymers may be used alone, or may be used in combination of two or more kinds without any problem. Furthermore, the second component only needs to contain the polyolefin-based resin, and may contain other resin components within the range in which the advantageous effects of the invention are not adversely affected, and a content of the polyolefin-based resin on the occasion is desirably 80 wt % or more, and further desirably 90 wt % or more. Above all, if availability, raw material cost, thermal fusing characteristics of the fibers obtained, texture and strength characteristics of a thermo-fused nonwoven fabric, and the like are taken into consideration, the second component is most preferably composed only of high density polyethylene.

A preferred combination of the first component and the second component in the invention is a combination in which the first component is polyethylene terephthalate and the second component is polyethylene. If the combination is applied, raw material cost, thermal fusing characteristics of the fibers obtained, texture and strength characteristics of the thermo-fused nonwoven fabric, and the like can be combined with the best balance, and therefore such a case is preferred.

To the first component and the second component forming the thermo-fusible conjugated fibers of the invention, within the range in which the advantageous effects of the invention are not adversely affected, an additive for allowing the fibers to exhibit various performance, for example, an antioxidant, a light stabilizer, an ultraviolet light absorber, a neutralizer, a nucleating agent, an epoxy stabilizer, a lubricant, an antibacterial agent, a deodorizer, a flame retardant, an antistatic agent, a pigment, a plasticizer or the like may be appropriately added, when necessary.

A volume ratio of the first component to the second component in the thermoplastic conjugated fibers of the invention is not particularly limited, but is preferably in the range of 20/80 to 80/20, and further preferably 40/60 to 60/40. When a volume of the first component is larger, a bulky nonwoven fabric is obtained, and when a volume of the second component is larger, a high strength nonwoven fabric is obtained. The volume ratio of the first component to the second component can be appropriately selected according to desired physical properties such as bulkiness and strength of the nonwoven fabric, and if the volume ratio is in the range of 20/80 to 80/20, various physical properties of the nonwoven fabric result in a satisfactory level, and if the volume ratio is in the range of 40/60 to 60/40, various physical properties of the nonwoven fabric result in the sufficient level.

Moreover, a conjugated form of the first component and the second component is not particularly limited, and any of conjugated forms such as side-by-side, concentric sheath-core and eccentric sheath-core can be adopted. When the conjugated form is in a sheath-core structure, the first component and the second component are preferably arranged in a core part and a sheath component, respectively. Furthermore, as a fiber cross-sectional shape, any of a round type such as a circle and an ellipse, an angular type such as a triangle and a square, a profile type such as a key type and an octofoil type, or a divided type or a hollow type can be adopted.

In the thermoplastic conjugated fibers of the invention, a work load at break calculated from a stress-strain curve in the tensile test of a single fiber is 1.6 cN·cm/dtex or more, further preferably 1.7 cN·cm/dtex or more, still further preferably 1.9 cN·cm/dtex or more, and particularly preferably 2.0 cN·cm/dtex or more. Here, the work load at break obtained by the tensile test means a numerical value defined by an area surrounded by the stress-strain curve and a horizontal axis when the horizontal axis is applied as strain [%] and a vertical axis is applied as stress [cN/dtex] to represent the work load, namely, an energy quantity required for the thermo-fusible conjugated fibers of the invention to be broken. In general, tensile characteristics of a fiber material are discussed using strength and elongation at break in many cases. However, in order to understand stress acting by deformation until the fibers are broken, and ductility until the fibers are broken, discussion of the work load at break becomes important. The large work load at break means that the work load at which the fibers can withstand until the fibers are broken is large, and means that the fibers are tenacious, namely, tough. Meanwhile, the small work load at break means that the fibers are broken only by action of a slight work load on the fibers, and means that such fibers are fragile and brittle.

When the thermo-fusible conjugated fibers of the invention are processed into a nonwoven fabric, the fibers are passed through steps such as fiber opening and web-forming. If a uniform nonwoven fabric is intended to be obtained with high productivity, excessive force acts on the fibers instantaneously or continuously. On the occasion, the fibers are damaged in no small part to cause break of the fibers or drop of components forming the fibers to form powdery defects or to cause nep-like fiber entanglement defects with damaged fibers as a starting point. Thus, an increase in productivity while maintaining high quality has been restricted by themselves. However, if the work load at break of the thermo-fusible conjugated fibers is 1.6 cN·cm/dtex or more, the fibers are hard to be damaged during processing into the nonwoven fabric, and both the quality and a processing speed of the nonwoven fabric can be satisfied at a satisfactory level. Then, if the work load at break is 1.7 cN·cm/dtex or more, both the quality and the processing speed of the nonwoven fabric can be satisfied at a still higher level, if the work load at break is 1.9 cN·cm/dtex or more, both the quality and the processing speed of the nonwoven fabric can be satisfied at a sufficient level, and if the work load at break is 2.0 cN·cm/dtex or more, the fibers are sufficiently applied to nonwoven processing and formation with a high-speed, and strength of the resulting nonwoven fabric can be improved. In addition, an upper limit of the work load at break is not particularly limited, but a balance between a difficulty level for improving the work load at break, and the advantageous effects obtained by the high work load at break is taken into consideration, the work load at break is preferably 4.0 cN·cm/dtex or less.

Moreover, in the thermo-fusible conjugated fibers of the invention, a ratio of strength at break to elongation at break (strength at break [cN/dtex]/elongation at break [%]) obtained by the tensile test of the single fiber is preferably in the range of 0.005 to 0.040, and a lower limit thereof is further preferably 0.010 or more, and an upper limit thereof is further preferably 0.030 or less, but not particularly limited thereto. The large ratio of the strength at break to the elongation at break means high strength and low elongation, and the small ratio of the strength at break to the elongation at break means low strength and high elongation. If the ratio is 0.005 or more, the strength and the bulkiness of the thermo-fused nonwoven fabric obtained by processing the thermo-fusible conjugated fibers have a satisfactory degree, and therefore such a case is preferred, and if the ratio is 0.010 or more, the strength and the bulkiness thereof are sufficient, and therefore such a case is further preferred. Moreover, if the ratio of the strength at break to the elongation at break is 0.040 or less, such poor performance as causing break of the thermo-fusible conjugated fibers during processing into the nonwoven fabric can be suppressed to a satisfactory degree, and if the ratio is 0.030 or less, such a defect can be sufficiently suppressed, and therefore such a case is preferred. If the ratio is 0.040 or less, and further preferably 0.030 or less, an effect of increased strength of the thermo-fused nonwoven fabric obtained is also obtained, and if mild thermally fusing conditions are applied in anticipation of the effect, an effect of obtaining a further bulky and flexible nonwoven fabric can also be enjoyed.

In the thermo-fusible fibers of the invention, the first component is preferably composed of polyethylene terephthalate, and the degree of crystallinity thereof is preferably 18% or more, and further preferably 20% or more, but not limited thereto. In the thermo-fusible fibers of the invention, as the degree of crystallinity of the first component is higher, a further bulky nonwoven fabric is formed, and if the degree of crystallinity of polyethylene terephthalate is 18% or more, the thermo-fused nonwoven fabric with high quality having no defects and the like, and bulkiness and soft texture can be obtained at a high processing speed, and if the degree of crystallinity is 20% or more, the thermo-fused nonwoven fabric having further bulkiness and very soft texture can be obtained. In addition, the degree of crystallinity of polyethylene terephthalate is preferably higher, and an upper limit thereof is not particularly limited. If a balance between a difficulty level for increasing the degree of crystallinity, and the effect obtained by a high degree of crystallinity is taken into consideration, the degree of crystallinity thereof is preferably 40% or less.

In the thermo-fusible conjugated fibers of the invention, fineness is preferably in the range of 0.8 to 5.6 dtex, and further preferably 1.2 to 3.3 dtex, but not limited thereto. While smaller fineness results in obtaining a nonwoven fabric having soft texture, larger fineness results in obtaining a nonwoven fabric excellent in permeability of a liquid or a gas. If the fineness is in the range of 0.8 to 5.6 dtex, various physical properties of the nonwoven fabric have a satisfactory level, and if the fineness is in the range of 1.2 to 3.3 dtex, various physical properties of the nonwoven fabric have a sufficient level.

A fiber length of the thermo-fusible conjugated fibers of the invention is not particularly limited, and can be appropriately selected in consideration of a web-forming method, productivity and required characteristics of the nonwoven fabric, and the like. Specific examples of the web-forming method include a dry process such as a carding process and an air-laid process, and a wet process such as a paper making process. In all the methods, the advantageous effects of the invention, namely, an effect of being able to suppress powdery defects or defects such as web texture disorder without breaking the fibers in an opening step or a web-forming step can be obtained. When the web is formed by the carding process, the effect can be particularly remarkably obtained. Moreover, in the case of fibers for a rod, fibers for a winding filter and fibers serving as a raw material of a wiping member, a fiber form of an uncut continuous tow can be adopted.

Crimps of the thermo-fusible conjugated fibers of the invention are not particularly limited, and presence or absence of the crimps, the number of the crimps, and crimp characteristics such as a crimp ratio, a residual crimp ratio and a crimp elastic modulus can be appropriately selected in consideration of the web-forming method, a specification of web-forming facilities, productivity and required physical properties of the nonwoven fabric, and the like. Moreover, a shape of the crimp is not particularly limited, either, and a mechanical crimp having a zigzag shape, a three-dimensional crimp having a spiral shape or an ohm shape, or the like can be appropriately selected. Furthermore, the crimp may be exposed or may be latent in the thermo-fusible conjugated fibers.

In the thermo-fusible conjugated fibers of the invention, a fiber treating agent is preferably attached on a surface thereof, but not limited thereto. Attachment of the fiber treating agent can suppress generation of static electricity in a fiber production process or a nonwoven fabric production process, or can dissolve poor performance such as entanglement or winding by friction or sticking, or can provide the resulting nonwoven fabric with hydrophilic or water-repellent characteristics. The fiber treating agent attached to the fibers is not particularly limited, and can be appropriately selected according to desired characteristics. Moreover, a method of attaching the fiber treating agent to the fibers is not particularly limited, either, and a publicly-known method, for example, a roller process, a dipping process, a spraying process, a pad dry process or the like can be adopted. Furthermore, an attachment amount of the fiber treating agent is not particularly limited, either, and can be appropriately selected according to the desired characteristics, and specific examples of the attachment amount include the range of 0.05 to 2.00 wt %, and further preferably the range of 0.20 to 1.00 wt %.

A method of obtaining the thermo-fusible conjugated fibers of the invention is not particularly limited, and all of publicly-known production methods for the thermo-fusible conjugated fibers of the invention can be adopted, and specific examples of the method of obtaining the thermo-fusible conjugated fibers with high productivity and high yield include the method described later.

Unstretched fibers serving as a raw material of the thermo-fusible conjugated fibers of the invention, in which a component containing the polyester-based resin is arranged in the first component and a component containing the polyolefinic resin is arranged in the second component, can be obtained by a general melt spinning method. Temperature conditions during melt spinning are not particularly limited, but a spinning temperature is preferably 230° C. or higher, further preferably 260° C. or higher, and still further preferably 300° C. or higher. If the spinning temperature is 230° C. or higher, the number of times of fiber breakage during spinning is reduced, and the unstretched fibers excellent in stretchability are obtained, and therefore such a case is preferred. If the spinning temperature is 260° C. or higher, the effects become further remarkable, and if the spinning temperature is 300° C. or higher, the effects become still further remarkable, and therefore such a case is preferred. Moreover, a spinning speed is not particularly limited, but is preferably 300 to 1500 m/min, and further preferably 600 to 1200 m/min. If the spinning speed is 300 m/min or more, a single-hole discharge amount for intending to obtain the unstretched fibers having arbitrary spinning fineness is increased, and satisfactory productivity is obtained, and therefore such a case is preferred. Moreover, if the spinning speed is 1500 m/min or less, elongation of the unstretched fibers is increased, and stability in a stretching step is improved, and therefore such a case is preferred. If the spinning speed is in the range of 600 to 1200 m/min, a balance between the productivity and the stability in the stretching step is excellent, and therefore such a case is further preferred.

As an extruder and a spinneret upon obtaining the unstretched fibers, the extruder and the spinneret having a publicly-known structure can be used. Moreover, as a cooling method in a process of taking up a fiber-shaped resin discharged from the spinneret, a conventional method can be adopted. In order to increase the elongation of the unstretched fibers, the resin is preferably cooled as mildly as possible by using cooling air, but not limited thereto.

In order to obtain the thermo-fusible conjugated fibers of the invention, a method of stretching the unstretched fibers is not particularly limited. The method applies multistep stretching in which stretching at a high temperature is combined with stretching at a low temperature, whereby the thermo-fusible conjugated fibers of the invention can be easily obtained with high productivity and the high yield, and therefore such a case is preferred. Various conditions such as a temperature, a stretching speed and a stretch ratio in stretching at the high temperature and stretching at the low temperature are not particularly limited, and can be appropriately set to be 1.6 cN·cm/dtex or more in the work load at break of the thermo-fusible conjugated fibers. For example, the stretching temperature in stretching at the high temperature is preferably in the range of 100 to 125° C., and further preferably in the range of 110 to 120° C.

Moreover, the stretching temperature in stretching at the low temperature is preferably in the range of 60 to 90° C., and further preferably in the range of 70 to 80° C. If a ratio of hot-temperature stretch ratio/low-temperature stretch ratio increases, the work load at break of the thermo-fusible conjugated fibers tends to increase, and the ratio can be appropriately adjusted while observing various other physical properties of the thermo-fusible conjugated fibers. The ratio of hot-temperature stretch ratio/low-temperature stretch ratio is not particularly limited, and is preferably in the range of 0.3 to 3.0, and further preferably in the range of 0.6 to 2.0. If the ratio of hot-temperature stretch ratio/low-temperature stretch ratio is 0.3 or more, the work load at break increases to a satisfactory degree, and the advantageous effects of the invention can be obtained. Moreover, if the ratio of hot-temperature stretch ratio/low-temperature stretch ratio is 0.3 or less, the thermo-fusible conjugated fibers excellent in bulkiness can be obtained while maintaining a satisfactory numerical value of the work load at break. If the ratio of high-temperature stretch ratio/low-temperature stretch ratio is in the range of 0.6 to 2.0, both processability and high-speed productivity of the nonwoven fabric, and various physical properties of the resulting nonwoven fabric such as strength, bulkiness and flexibility can be satisfied with a high level.

Moreover, a total stretch ratio represented by a product of the high-temperature stretch ratio and the low-temperature stretch ratio is not particularly limited. From a viewpoint of obtaining the thermo-fusible conjugated fibers having desired fineness with high productivity, a higher total stretch ratio is better, and the total stretch ratio is preferably 2.5 times or more, further preferably 3.5 times or more, and still further preferably 4.5 times or more.

The thermo-fusible conjugated fibers of the invention are preferably heat-treated after stretching, but not limited thereto. Application of heat treatment after stretching causes an increase in crystallinity of the polyester-based resin being the first component of the thermo-fusible conjugated fibers, which can improve bulkiness upon processing the fibers into the thermo-fused nonwoven fabric. A method of heat treatment is not particularly limited, and may be heat treatment by contact with a heat roll or a hot plate, or heat treatment by heated air or heated steam, or heat treatment in a state in which the thermo-fusible conjugated fibers are restricted at a fixed length, or heat treatment in a state in which the fibers are relaxed. Moreover, a heat treatment temperature is not particularly limited, but the temperature is preferably as high as possible within the range in which the thermo-fusible conjugated fibers are not fused to each other, and specific examples thereof include the range of 90 to 130° C., and further preferably the range of 100 to 120° C. A heat treatment time is not particularly limited, either, but is preferably as long as possible within the range in which operability is not adversely affected, and specifically is 5 seconds or more, further preferably 30 seconds or more, and still further preferably 3 minutes or more.

The thermo-fusible conjugated fibers of the invention are formed into the web, and then are bonded among the fibers by thermal fusion and formed into the nonwoven fabric or the like. The nonwoven fabric may be formed of one kind of the thermo-fusible conjugated fibers of the invention, or may be formed of two or more kinds of the thermo-fusible conjugated fibers. Moreover, the nonwoven fabric may contain fibers other than the thermo-fusible conjugated fibers of the invention to an extent to which the advantageous effects of the invention are not adversely affected. Specific examples of such fibers include publicly-known conjugated fibers, single component fibers, cotton and rayon. The nonwoven fabric formed of two or more kinds of the fibers may be a mixed fiber nonwoven fabric of the fibers, or may be a multilayered nonwoven fabric in which the respective fibers form layers independently, or may be a mixed-fiber multilayered nonwoven fabric in combination of the fibers.

A web thermal fusion method is not particularly limited, and all publicly-known methods can be adopted. Specific examples thereof include an air-through system in which circulating hot air is passed through a web to thermally fuse points among fibers, a floating dryer system in which the fibers are thermally fused while the web is floated by hot air, a system in which the fibers are thermally fused by high-pressure steam or superheated steam, and an embossing system or a calender system in which the fibers are thermally fused by pressure bonding at a high temperature. Among the methods, from a viewpoint of easily obtaining a bulky and flexible nonwoven fabric, the air-through system is most preferred. Moreover, various conditions such as a temperature and a time upon thermal fusion are not particularly limited, but the thermo-fusible conjugated fibers of the invention have features of increased nonwoven fabric strength than a case where the thermo-fusible conjugated fibers having the work load at break smaller than 1.6 cN·cm/dtex are processed. Even if temperate conditions such as a low thermal fusion temperature and a short thermal fusion time are set in anticipation of the features, an objective nonwoven fabric can be obtained, and the nonwoven fabric having flexible texture can be obtained while maintaining required nonwoven fabric strength, and therefore such a case is preferred.

The nonwoven fabric obtained by processing the thermo-fusible conjugated fibers of the invention can be preferably used for various products as members such as a diaper and a napkin, for example, by taking advantage of the bulkiness and the flexible texture, and as members such as a filtering medium and a wiping sheet, for example, by taking advantage of the features of obtaining the high nonwoven strength, but not limited thereto.

EXAMPLES

Hereinafter, the invention will be described by Examples and Comparative Examples in detail, but the invention is not limited by the Examples and Comparative Example. In addition, methods for determining values of physical properties or definitions shown in Examples and Comparative Examples will be described below.

Fineness, Strength at Break, Elongation at Break, Work Load at Break

Fineness, and strength and elongation of 50 thermo-fusible conjugated fibers randomly sampled were measured by using FAVIMAT, which is a single-fiber strength and elongation tester, made by Textechno Herbert Stein GmbH & Co. to calculate a mean value. As conditions of strength and elongation measurement, a gauge length was adjusted to 10 mm, a tensile speed was adjusted to 20 mm/min, and strength upon breaking and elongation upon breaking were defined as strength at break [cN/dtex] and elongation at break [%], respectively. A numerical value obtained by dividing an area surrounded by a stress-strain curve and a horizontal axis by fineness [dtex] when the horizontal axis represents strain [cm] and a vertical axis represents stress [cN] was defined as a work load at break [cN·cm/dtex].

Degree of Crystallinity of Polyethylene Terephthalate

A laser Raman microscope made by Nanophoton Corporation was used, and a degree of crystallinity was calculated by equations described below.

$$\text{Reduced density } \rho[\text{g/cm}^3]=(305-\Delta\nu_{1730})/209_{1730}$$

$$\text{Degree of crystallinity } [\%]=100\times(\rho-1.335)/(1.455-1.335)$$

where, $\Delta\nu_{1730}$ represents a full width at half maximum of a Raman band (C═O stretching band) near 1730 $cm^{-1}$.

Resistance to Break of Fibers in Nonwoven Fabric-Forming Step

Through a miniature carding machine made by Takeuchi Mfg. Co., Ltd., 50 g of thermo-fusible conjugated fibers was repeatedly passed 5 times, and from an amount of fiber broken flocks generated on the occasion, resistance to break of the fibers in a nonwoven fabric-forming step was evaluated based on criteria described below.

Evaluation Criteria

Excellent: Fiber broken flocks dropped under the carding machine were not found, and defects derived from the fiber broken flocks did not exist in a web passed through the carding machine, and a sufficient conforming product rate was achieved.

Good: The fiber broken flocks dropped under the carding machine were found, but the defects derived from the fiber broken flocks did not exist in the web passed through the carding machine, and an adequate conforming product rate was achieved.

Marginal: The fiber broken flocks dropped under the carding machine were found, and the defects derived from the fiber broken flocks existed in the web passed through the carding machine, but a satisfactory conforming product rate was achieved.

Poor: The fiber broken flocks dropped under the carding machine were found, and the defects derived from the fiber broken flocks existed in the web passed through the carding machine, and an allowable conforming product rate was not achieved.

Nonwoven Fabric Physical Properties

A web prepared by using a miniature carding machine made by Takeuchi Mfg. Co., Ltd. was heat-treated for 15 seconds by circulating hot air at 138° C. by using an air-through processing machine to obtain a thermo-fused nonwoven fabric. The nonwoven fabric was cut into a piece of 150 mm×150 mm, and basis weight [g/m$^2$] and a thickness at a load of 3.5 g/cm$^2$ were measured to calculate a specific volume [cm$^3$/g]. Then, the nonwoven fabric was cut into a piece of 150 mm in a length direction and 50 mm in a crosswise direction, and strength and elongation in a machine direction and a crosswise direction were measured under conditions of a gauge length of 100 mm and a tensile speed of 200 mm/min to calculate mean strength from an equation described below.

$$\text{Mean strength [N/50 mm]} = (\text{strength in machine direction [N/50 mm]} \times \text{strength in crosswise direction [N/50 mm]})^{1/2}$$

EXAMPLE 1

As a first component, polyethylene terephthalate (melting point: 250° C.) having an Intrinsic Viscosity (IV) value of 0.64 was used, and as a second component, high density polyethylene (melting point: 130° C.) having a melt index (measured at 190° C.) of 22 g/10 min was used.

The first component being a high-melting-point component was arranged in a core, and the second component being a low-melting-point component was arranged in a sheath, and the first component and the second component were conjugated in a cross-sectional form of sheath/core=50/50 to obtain unstretched fibers having fineness of 15.0 dtex under conditions of a spinning speed of 900 m/min. The resulting unstretched fibers were stretched 2.5 times at 110° C., and then 3.0 times at 80° C. by a heat roll stretching machine to obtain thermo-fusible conjugated fibers having fineness of 2.0 dtex. The thermo-fusible conjugated fibers had strength at break of 2.58 cN/dtex, elongation at break of 134%, a ratio of strength at break/elongation at break of 0.019, and a work load at break of 2.48 cN·cm/dtex, and had a sufficiently high work load at break. Moreover, a degree of crystallinity of polyethylene terephthalate measured by Raman spectroscopy was 21%.

The thermo-fusible conjugated fibers were processed into a web by a carding process, and the web was heat-treated by an air-through processing machine to prepare a thermo-fused nonwoven fabric. Break resistance of the fibers in the carding process was significantly excellent, resulted in neither generation of fiber broken flocks nor development of defects with a broken portion as a starting point, and in sufficient processability. Mean strength of the resulting nonwoven fabric was 23 N/50 mm, and a specific volume thereof was 75 cm$^3$/g. The resulting nonwoven fabric had sufficient bulkiness and soft texture, and was able to be preferably used as a topsheet of a diaper, for example.

Example 2

As a first component, polyethylene terephthalate (melting point: 250° C.) having an IV value of 0.64 was used, and as a second component, high density polyethylene (melting point: 130° C.) having a melt index (measured at 190° C.) of 16 g/10 min was used.

The first component being a high-melting-point component was arranged in a core, and the second component being a low-melting-point component was arranged in a sheath, and the first component and the second component were conjugated in a cross-sectional form of sheath/core=60/40 to obtain unstretched fibers having fineness of 15.0 dtex under conditions of a spinning speed of 900 m/min. The resulting unstretched fibers were stretched 3.0 times at 120° C., and then 2.0 times at 70° C. by a heat roll stretching machine to obtain thermo-fusible conjugated fibers having fineness of 2.5 dtex. The thermo-fusible conjugated fibers had strength at break of 2.84 cN/dtex, elongation at break of 130%, a ratio of strength at break/elongation at break of 0.022, and a work load at break of 2.69 cN·cm/dtex, and had a sufficiently high work load at break. Moreover, a degree of crystallinity of polyethylene terephthalate measured by Raman spectroscopy was 20%.

The thermo-fusible conjugated fibers were processed into a web by a carding process, and the web was heat-treated by an air-through processing machine to prepare a thermo-fused nonwoven fabric. Break resistance of the fibers in the carding process was significantly excellent, resulted in neither generation of fiber broken flocks nor development of defects with a broken portion as a starting point, and in sufficient processability. Mean strength of the resulting nonwoven fabric was 24 N/50 mm, and a specific volume thereof was 70 cm$^3$/g. The resulting nonwoven fabric had sufficient bulkiness and soft texture, and was able to be preferably used as a topsheet of a diaper, for example.

Example 3

As a first component, polyethylene terephthalate (melting point: 250° C.) having an IV value of 0.64 was used, and as a second component, linear low density polyethylene (melting point: 125° C.) having a melt index (measured at 190° C.) of 16 g/10 min was used.

The first component being a high-melting-point component was arranged in a core, and the second component being a low-melting-point component was arranged in a sheath, and the first component and the second component were conjugated in a cross-sectional form of sheath/core=50/50 to obtain unstretched fibers having fineness of 10.0 dtex under conditions of a spinning speed of 700 m/min. The resulting unstretched fibers were stretched 2.0 times at 120° C., and then 3.0 times at 70° C. by a heat roll stretching machine to obtain thermo-fusible conjugated fibers having fineness of 1.7 dtex. The thermo-fusible conjugated fibers had strength at break of 2.45 cN/dtex, elongation at break of 129%, a ratio of strength at break/elongation at break of 0.019, and a work load at break of 2.23 cN·cm/dtex, and had a sufficiently high work load at break. Moreover, a degree of crystallinity of polyethylene terephthalate measured by Raman spectroscopy was 21%.

The thermo-fusible conjugated fibers were processed into a web by a carding process, and the web was heat-treated by an air-through processing machine to prepare a thermo-fused nonwoven fabric. Break resistance of the fibers in the carding process was sufficient, resulted in neither generation of fiber broken flocks nor development of defects with a broken portion as a starting point, and in satisfactory processability. Mean strength of the resulting nonwoven fabric was 21 N/50 mm, and a specific volume thereof was 72 $cm^3/g$. The resulting nonwoven fabric had sufficiently bulkiness and very soft texture because the linear low density polyethylene was arranged on a fiber surface, and was able to be preferably used as a topsheet of a diaper, for example.

Example 4

As a first component, polyethylene terephthalate (melting point: 250° C.) having an IV value of 0.64 was used, and as a second component, high density polyethylene (melting point: 130° C.) having a melt index (measured at 190° C.) of 16 g/10 min was used.

The first component being a high-melting-point component was arranged in a core, and the second component being a low-melting-point component was arranged in a sheath, and the first component and the second component were conjugated in a cross-sectional form of sheath/core=50/50 to obtain unstretched fibers having fineness of 10.0 dtex under conditions of a spinning speed of 700 m/min. The resulting unstretched fibers were stretched 2.5 times at 120° C., and then 3.0 times at 70° C. by a heat roll stretching machine to obtain thermo-fusible conjugated fibers having fineness of 1.3 dtex. The thermo-fusible conjugated fibers had strength at break of 2.91 cN/dtex, elongation at break of 100%, a ratio of strength at break/elongation at break of 0.029, and a work load at break of 2.11 cN·cm/dtex, and had a sufficiently high work load at break. Moreover, a degree of crystallinity of polyethylene terephthalate measured by Raman spectroscopy was 23%.

The thermo-fusible conjugated fibers were processed into a web by a carding process, and the web was heat-treated by an air-through processing machine to prepare a thermo-fused nonwoven fabric. Break resistance of the fibers in the carding process was sufficient, resulted in neither generation of fiber broken flocks nor development of defects with a broken portion as a starting point, and in satisfactory processability. Mean strength of the resulting nonwoven fabric was 23 N/50 mm, and a specific volume thereof was 78 $cm^3/g$. The resulting nonwoven fabric had sufficient bulkiness and very soft texture in view of small fineness, and was able to be preferably used as a topsheet of a diaper, for example.

The mean strength of the nonwoven fabric was sufficiently high. Therefore, when 20 N/50 mm was set as a measure of the strength required upon processing the nonwoven fabric into a product, and an air-through processing temperature was changed in the range in which the mean strength was able to be maintained, the air-through processing temperature was able to be reduced to 133° C. Accordingly, the specific volume of the nonwoven fabric increased to 84 $cm^3/g$, and the nonwoven fabric having very soft texture was able to be obtained.

Example 5

The unstretched fibers in Example 4 were stretched 2.0 times at 110° C., and then 1.5 times at 80° C. by a heat roll stretching machine to obtain thermo-fusible conjugated fibers having fineness of 3.3 dtex. The thermo-fusible conjugated fibers had strength at break of 1.64 cN/dtex, elongation at break of 294%, a ratio of strength at break/elongation at break of 0.006, and a work load at break of 2.93 cN·cm/dtex, and had a sufficiently high work load at break. Moreover, a degree of crystallinity of polyethylene terephthalate measured by Raman spectroscopy was 15%. The thermo-fusible conjugated fibers were processed into a web by a carding process, and the web was heat-treated by an air-through processing machine to prepare a thermo-fused nonwoven fabric. Break resistance of the fibers in the carding process was significantly excellent, resulted in neither generation of fiber broken flocks nor development of defects with a broken portion as a starting point, and in sufficient processability.

Mean strength of the resulting nonwoven fabric was 26 N/50 mm, and a specific volume thereof was 55 $cm^3/g$. The degree of crystallinity of polyethylene terephthalate was low. Therefore, while the specific volume of the resulting nonwoven fabric was somewhat low, and texture such as flexibility was not sufficient, a satisfactory level was achieved.

Comparative Example 1

The same unstretched fibers as in Example 1 were tried to be stretched 2.5 times at 90° C., and then stretched again at 80° C. by a heat roll stretching machine, but breakage during stretching was caused, whereby stretched fibers were unable to be obtained. Then, the fibers were one-step stretched 3.0 times at 90° C. to obtain thermo-fusible conjugated fibers having fineness of 5.0 dtex. The thermo-fusible conjugated fibers had strength at break of 2.94 cN/dtex, elongation at break of 64%, a ratio of strength at break/elongation at break of 0.046, and a work load at break of 1.41 cN·cm/dtex, and had a work load at break smaller than the work load at break of the thermo-fusible conjugated fibers in Example 1, and were brittle. Moreover, a degree of crystallinity of polyethylene terephthalate measured by Raman spectroscopy was 23%.

The thermo-fusible conjugated fibers were processed into a web by a carding process, and the web was heat-treated by an air-through processing machine to prepare a thermo-fused nonwoven fabric. In the carding process, an aspect in which the fibers were broken and short fibers dropped was observed, and defects in a shape of fiber entanglement with damaged fibers as a starting point were developed in several cases, and satisfactory processability was not achieved. Mean strength of the resulting nonwoven fabric was 17 N/50 mm, and a specific volume thereof was 72 $cm^3/g$. The resulting nonwoven fabric had hard texture in view of large fineness, and was unsuitable for an application required to have flexibility, such as a topsheet of a diaper, for example.

Comparative Example 2

Unstretched fibers were obtained under the same conditions as in Example 1 except that fineness of the unstretched fibers was adjusted to 7.5 dtex, and the fibers were one-step stretched 3.0 times at 90° C. by a heat roll stretching machine to obtain thermo-fusible conjugated fibers having fineness of 2.5 dtex. The thermo-fusible conjugated fibers had strength at break of 3.30 cN/dtex, elongation at break of 51%, a ratio of strength at break/elongation at break of 0.065, and a work load at break of 1.16 cN·cm/dtex, and had a work load at break smaller than the work load at break of the thermo-fusible conjugated fibers in Example 1, and were brittle. Moreover, a degree of crystallinity of polyethylene terephthalate measured by Raman spectroscopy was 23%.

The thermo-fusible conjugated fibers were processed into a web by a carding process, and the web was heat-treated by an air-through processing machine to prepare a thermo-fused nonwoven fabric. In the carding process, an aspect in which the fibers were broken and short fibers dropped was observed, and defects in a shape of fiber entanglement with damaged fibers as a starting point were developed in several cases, and satisfactory processability was not achieved. Mean strength of the resulting nonwoven fabric was 19 N/50 mm, and a specific volume thereof was 70 $cm^3/g$. The resulting nonwoven fabric had hard texture in view of large fineness, and was unsuitable for an application required to have flexibility, such as a topsheet of a diaper, for example.

Comparative Example 3

Unstretched fibers were obtained under the same conditions as in Example 2 except that fineness of the unstretched fibers was adjusted to 6.0 dtex, and the fibers were stretched 2.5 times at 90° C., and then 1.2 times at 90° C. by a heat roll stretching machine to obtain thermo-fusible conjugated fibers having fineness of 2.0 dtex. The thermo-fusible conjugated fibers had strength at break of 3.31 cN/dtex, elongation at break of 61%, a ratio of strength at break/elongation at break of 0.054, and a work load at break of 1.48 cN·cm/dtex, and had a work load at break smaller than in Examples, and were brittle. Moreover, a degree of crystallinity of polyethylene terephthalate measured by Raman spectroscopy was 20%.

The thermo-fusible conjugated fibers were processed into a web by a carding process, and the web was heat-treated by an air-through processing machine to prepare a thermo-fused nonwoven fabric. In the carding process, an aspect in which the fibers were broken and short fibers dropped was observed, and defects in a shape of fiber entanglement with damaged fibers as a starting point were developed in several cases, and satisfactory processability was not achieved. Mean strength of the resulting nonwoven fabric was 18 N/50 mm, and a specific volume thereof was 69 $cm^3/g$. The resulting nonwoven fabric contained the defects developed in the carding process, and when the nonwoven fabric was used for a topsheet of a diaper, irritation to skin, or the like was of concern, for example.

The evaluation results of physical properties of the fibers and the nonwoven fabrics in Examples and Comparative Examples are collectively shown in Table 1.

TABLE 1

| | | Example 1 | Example 2 | Example 3 | Example 4 | Example 5 | Comparative Example 1 | Comparative Example 2 | Comparative Example 3 |
|---|---|---|---|---|---|---|---|---|---|
| Evaluation of physical properties of fibers | Fineness [dtex] | 2.0 | 2.5 | 1.7 | 1.3 | 3.3 | 5.0 | 2.5 | 2.0 |
| | Strength at break [cN/dtex] | 2.58 | 2.84 | 2.45 | 2.91 | 1.64 | 2.94 | 3.30 | 3.31 |
| | Elongation at break [%] | 134 | 130 | 129 | 100 | 294 | 64 | 51 | 61 |
| | Work load at break [cN · cm/dtex] | 2.48 | 2.69 | 2.23 | 2.11 | 2.93 | 1.41 | 1.16 | 1.48 |
| | Strength at break/elongation at break | 0.019 | 0.022 | 0.019 | 0.029 | 0.006 | 0.046 | 0.065 | 0.054 |
| | Degree of crystallinity [%] | 21 | 20 | 21 | 23 | 15 | 23 | 23 | 20 |
| Evaluation of physical properties of nonwoven fabric | Break resistance | Excellent | Excellent | Good | Good | Excellent | Marginal | Marginal | Marginal |
| | Nonwoven fabric mean strength [N/50 mm] | 23 | 24 | 21 | 23 | 26 | 17 | 19 | 18 |
| | Nonwoven fabric specific volume [$cm^3/g$] | 75 | 70 | 72 | 78 | 55 | 72 | 70 | 69 |

As an example of the stress-strain curve of the thermo-fusible conjugated fibers having a work load at break of 1.6 cN·cm/dtex or more, the measured results in Example 2 are shown in FIG. 1. Moreover, as an example of the stress-strain curve of the conventional thermo-fusible conjugated fibers having a work load at break smaller than 1.6 cN·cm/dtex, the measured results in Comparative Example 2 are shown in FIG. 2.

Figure 2:
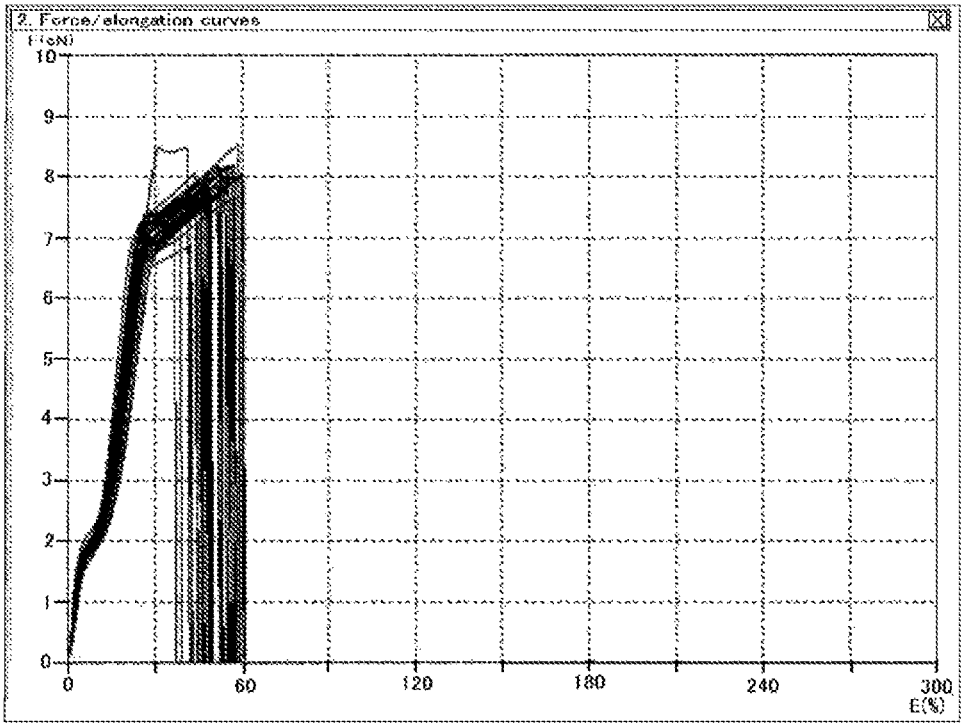
FIG. 2 is a diagram showing measured results of a stress-strain curve of thermo-fusible conjugated fibers in Comparative Example 2.

From the results in Table 1, FIG. 1 and FIG. 2, in Examples 1 to 5 according to the invention, the work load at break of the fibers is 1.6 cN·cm/dtex or more, and damage such as fiber break in the carding process is suppressed, and the thermo-fused nonwoven fabric can be obtained with good operability and processability. Moreover, the resulting nonwoven fabric exhibited features of increased nonwoven fabric strength in comparison with the thermo-fusible conjugated fibers having the small work load at break. In addition, in Example 5, while the degree of crystallinity of polyethylene terephthalate was low, the specific volume of the nonwoven fabric was somewhat low and the texture thereof was insufficient, the satisfactory level was achieved.

On the other hand, the thermo-fusible conjugated fibers in Comparative Examples 1 to 3 had the work load at break lower than 1.6 cN·cm/dtex, and received damage such as fiber break in the carding process to develop the defects with damaged fibers as a starting point, and therefore the fibers resulted in deterioration of nonwoven fabric texture and reduction of a conforming product rate.

Although the invention has been described in detail and with reference to specific embodiments, it will be apparent to those skilled in the art that various alterations and modifications can be made without departing from the spirit and the scope of the invention. The present application is based on Japanese Patent Application filed on Mar. 31, 2017 (Japanese Patent Application No. 2017-072662), the contents of which are incorporated herein by reference.

INDUSTRIAL APPLICABILITY

Thermo-fusible conjugated fibers formed of a polyester-based resin and a polyolefin-based resin according to the invention can suppress poor performance such as break of the fibers in a nonwoven fabric production process, and therefore a nonwoven fabric can be obtained at a high production speed. Furthermore, a thermo-fused nonwoven fabric obtained from the thermo-fusible conjugated fibers of the invention has features of increased nonwoven fabric strength, and mild thermal fusion conditions are adopted in anticipation of the features, whereby the nonwoven fabric having higher bulkiness and further flexible texture than ever before can be obtained while maintaining required nonwoven fabric strength. Thanks to such features, the thermo-fusible conjugated fibers and the nonwoven fabric formed of the thermo-fusible conjugated fibers according to the invention can be preferably used in a hygienic material application such as a diaper and a napkin and an industrial material application such as a filtering medium and a wiping sheet.

What is claimed is:

1. Thermo-fusible conjugated fibers comprising a first component containing a polyester-based resin and a second component containing a polyolefin-based resin, wherein a melting point of the second component is 10° C. or more lower than a melting point of the first component, a work load at break obtained by a tensile test is 2.0 cN·cm/dtex or more, a ratio of strength at break to elongation at break (strength at break [cN/dtex]/elongation at break [%]) obtained by a tensile test is more than 0.010 and 0.030 or less.

2. The thermo-fusible conjugated fibers according to claim 1, wherein the first component is polyethylene terephthalate, and the second component is polyethylene.

3. The thermo-fusible conjugated fibers according to claim 2, wherein a degree of crystallinity of the polyethylene terephthalate is 18% or more.

4. A nonwoven fabric, obtained by processing the thermo-fusible conjugated fibers according to claim 1.

5. A product, using the nonwoven fabric according to claim 4.

6. A nonwoven fabric, obtained by processing the thermo-fusible conjugated fibers according to claim 2.

7. A nonwoven fabric, obtained by processing the thermo-fusible conjugated fibers according to claim 3.

8. A product, using the nonwoven fabric according to claim 6.

9. A product, using the nonwoven fabric according to claim 7.

* * * * *